US006776228B2

(12) United States Patent
Pedersen et al.

(10) Patent No.: US 6,776,228 B2
(45) Date of Patent: Aug. 17, 2004

(54) BALL DROPPING ASSEMBLY

(75) Inventors: Gerald D. Pedersen, Houston, TX (US); David E. Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 22 days.

(21) Appl. No.: 10/208,568

(22) Filed: Jul. 30, 2002

(65) Prior Publication Data

US 2003/0155114 A1 Aug. 21, 2003

Related U.S. Application Data

(63) Continuation-in-part of application No. 10/081,062, filed on Feb. 21, 2002, now Pat. No. 6,715,541.

(51) Int. Cl.[7] ..... E21B 33/13
(52) U.S. Cl. ..... 166/75.15; 166/177.4
(58) Field of Search ..... 166/75.15, 193, 166/177.4, 291

(56) References Cited

U.S. PATENT DOCUMENTS

| | | | | |
|---|---|---|---|---|
| 1,827,257 A | | 10/1931 | Parker | |
| 2,630,179 A | | 3/1953 | Brown | 166/291 |
| 3,086,587 A | | 4/1963 | Zandmer et al. | 166/284 |
| 3,444,928 A | | 5/1969 | Pitts | 166/70 |
| 3,971,436 A | | 7/1976 | Lee | 166/70 |
| 4,164,980 A | | 8/1979 | Duke | 166/291 |
| 4,427,065 A | | 1/1984 | Watson | 166/250 |
| 4,491,177 A | | 1/1985 | Baugh | 166/75 R |
| 4,674,573 A | | 6/1987 | Bode | 166/291 |
| 4,782,894 A | | 11/1988 | LaFleur | 166/70 |
| 4,917,184 A | * | 4/1990 | Freeman et al. | 166/285 |
| 5,236,035 A | | 8/1993 | Brisco et al. | 166/70 |
| 5,443,122 A | | 8/1995 | Brisco | 166/285 |
| 5,553,667 A | | 9/1996 | Budde et al. | 166/70 |
| 5,758,726 A | | 6/1998 | Streich et al. | 166/379 |
| 5,833,002 A | | 11/1998 | Holcombe | 166/291 |
| 5,890,537 A | | 4/1999 | Lavaure et al. | 166/285 |
| 5,950,724 A | | 9/1999 | Giebeler | 166/70 |
| 5,960,881 A | | 10/1999 | Allamon et al. | 166/291 |
| 6,182,752 B1 | | 2/2001 | Smith, Jr. et al. | 166/70 |
| 6,206,095 B1 | | 3/2001 | Baugh | 166/70 |
| 6,220,360 B1 | | 4/2001 | Connell et al. | 166/373 |
| 6,279,654 B1 | | 8/2001 | Mosing et al. | 166/285 |
| 6,311,711 B1 | | 11/2001 | Skoglund | 137/2 |

FOREIGN PATENT DOCUMENTS

EP 0 969 183 A2 1/2000 ..... E21B/33/16

OTHER PUBLICATIONS

USSN 10/066,460, Filed Jan. 31, 2002, Pederson, et al. "Plug–Dropping Container For Releasing A Plug Into A Wellbore."

(List continued on next page.)

*Primary Examiner*—William Neuder
(74) *Attorney, Agent, or Firm*—Moser, Patterson & Sheridan, L.L.P.

(57) ABSTRACT

A ball dropping assembly for dropping a plurality of objects, such as spherical balls, into a wellbore. The assembly first comprises a seat for retaining a ball before it is released. The assembly also comprises a ball-feeding channel for feeding additional balls onto the seat. A ball-retaining lever is provided to selectively receive and retain balls onto the seat, and then to release the balls individually into the wellbore. In one embodiment, the assembly is attached to a side bore in fluid communication with a main bore in a cementing head. The ball-retaining lever rotates into the bore when releasing a ball. When a plug is released into the bore from a cementing head, the plug will trip the lever, causing the ball-retaining lever to rotate back towards the ball-retained position. Thus, the ball dropping assembly also serves as a plug release indicator.

30 Claims, 8 Drawing Sheets

FOREIGN PATENT DOCUMENTS

Liner Hangers, Bestline Liner Systems, Inc., 2000/2001 General Catalog, Bakersfield, CA, E–mail: bestlinelinersystems.com, 3 Pages.
Cementing Manifold & Wiper Plugs, Applied Technologies, Inc. (ATI), 1 Page.
Liner Hangers, Open Hole Completion Systems, Baker Oil Tools, 6 Pages.
USSN 10/616,643, Filed Jul. 10, 2003, Pederson, et al., "Plug–Dropping Container For Releasing A Plug Into A Wellbore."
PCT International Search Report, International Application No. PCT/GB03/00307, dated May 21, 2003.
PCT International Search Report, International Application No. PCT/GB03/00714, dated Jul. 4, 2003.

* cited by examiner

BALL DROPPING ASSEMBLY

RELATED APPLICATIONS

This application is a continuation-in-part of an earlier application entitled "BALL DROPPING ASSEMBLY." That application was filed on Feb. 21, 2002, and has U.S. Ser. No. 10/081,062 now U.S. Pat. No. 6,715,541. The parent application is incorporated herein in its entirety, by reference.

BACKGROUND OF THE INVENTION

1. Field of the Invention

The present invention generally relates to an apparatus for dropping balls into a wellbore. More particularly, the invention relates to an apparatus for dropping one or more balls and that may also be used as an indicator that a plug has been released into a string of drill pipe.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing. Afterwards, the second casing string is also cemented. This process is typically repeated with additional liner strings until the well has been drilled to total depth. In this manner, wells are typically formed with two or more strings of casing of an ever-decreasing diameter.

In the process of forming a wellbore, it is sometimes desirable to utilize various plugs. Plugs typically define an elongated elastomeric body used to separate fluids pumped into a wellbore. Plugs are commonly used, for example, during the cementing operations for a liner.

The process of cementing a liner into a wellbore typically involves the use of both liner wiper plugs and drill-pipe darts. A liner wiper plug is typically located inside the top of a liner, and is lowered into the wellbore with the liner at the bottom of a working string. The liner wiper plug has a cylindrical bore through it to allow passage of fluids. The cylindrical bore also serves as a seat for receiving a drill pipe dart.

After the liner and the attached liner wiper plug is in place, fluid is injected into the wellbore through the working string. The fluid is typically a circulating fluid, or cement. After a sufficient volume of circulating fluid or cement has been placed into the wellbore, the drill pipe dart (sometimes referred to as a pump-down plug) is launched. Using drilling mud, cement, or other displacement fluid, the dart is pumped into the working string. As the dart travels downhole, it seats against the liner wiper plug, closing off the internal bore through the liner wiper plug. Hydraulic pressure above the dart forces the dart and the wiper plug to dislodge from the bottom of the working string and to be pumped down the liner together. This forces the circulating fluid or cement that is ahead of the wiper plug and dart to travel down the liner and to u-turn up into the liner annulus. The liner wiper plug has radial wipers to contact and wipe the inside of the liner as the plug travels down the liner.

The cementing operation described above utilizes a cementing head apparatus at the top of the wellbore for injecting cement and other fluids downhole, and for releasing the plugs. The cementing head typically includes a dart releasing apparatus, referred to sometimes as a plug-dropping container. Darts used during a cementing operation are held at the surface by the plug-dropping container. The plug-dropping container is incorporated into the cementing head above the wellbore. The typical cementing head also includes some mechanism which allows cement or other fluid to be diverted around the dart until plug-release is desired. Fluid is directed to bypass the dart in some manner within the container until it is ready for release, at which time the fluid is directed to flow behind the plug and force it downhole.

The cementing head often includes a plug release indicator, which informs the operator at the surface that a plug has been released. Generally, the release indicator is located below the plug-dropping container and must be reset after each plug is released. In one arrangement, the plug release indicator has a finger that protrudes into the bore of the cementing head. The finger may be "tripped" by a passing plug in the bore to give a positive indication that a plug has been released. The release indicator has an indicator flag located outside of the cementing head that is visible to an operator to indicate release of a plug downhole through the drill pipe.

Plug release indicators are designed to prevent accidental tripping by fluid flow in the bore. Many release indicators use spring washers to resist fluid forces and to maintain the finger in the bore until the released plug trips the finger. However, the setting of the spring washer must be balanced between resisting fluid flow and indicating plug release. If the setting of the spring is too tight, the force required to trip the indicator may be high enough to impede the downward travel of the plug. If the spring setting is too loose, it may be prematurely tripped.

Another common component of a cementing head or other fluid circulation system is a ball dropping assembly for dropping a ball into the pipe string. The ball may be dropped for many purposes. For instance, the ball may be dropped onto a seat located in the wellbore to close off the wellbore. Sealing off the wellbore allows pressure to build up in the wellbore to actuate a downhole tool such as a packer, a liner hanger, a running tool, or a valve. The ball may also be dropped to shear a pin to operate a downhole tool. Balls are also sometimes used in cementing operations to divert the flow of cement during staged cementing operations. Balls are also used to convert float equipment. Thus, multiple balls may be sequentially dropped during a completion operation.

Many ball-dropping assemblies use a retaining device to keep the ball out of the flow stream until release. The retaining device generally includes a plunger that uses linear movement to push the ball into the flow stream at the time of release. These designs tend to extend out from the main body of the cement head, and require numerous manual turns of a wheel to release the ball.

In the assembly of a cementing head, the plug release indicator is typically disposed below the ball dropping assembly in order to verify that a released plug has cleared all possible obstructions in the cementing head. One drawback of this design is that the plug release indicator must be retracted before a ball is released. Additionally, stacking the ball dropping assembly over the plug release indicator increases the length and size of the head member. Furthermore, two different actuators are required to separately actuate a plug release indicator and a ball dropping mechanism.

Therefore, a need exists for a ball dropping assembly that can both drop a ball into the wellbore and indicate that a plug has been released. There is a further need for an apparatus for dropping a ball and for indicating plug release that is more compact, efficient, and inexpensive than using two separate devices for performing these functions. Still further, there is a need for a ball dropping assembly which allows a ball to be dropped into a wellbore without separately retracting a plug release indicator. There is also a need for a combined dart release indicator and ball-dropping apparatus which will reduce the actuator power and control system requirements for remotely controlled operations. Finally, there is a need for such an apparatus that allows for the sequential dropping of more than one ball.

SUMMARY OF THE INVENTION

The present invention provides a ball dropping assembly for use in wellbore operations. The novel assembly provides a means for both dropping a ball and for indicating that a plug has been released from a cementing head or other plug-dropping apparatus into a wellbore. The assembly of the present invention first comprises a seat for retaining a ball before it is released. The apparatus further comprises a lever for retaining the ball in the seat. The ball-retaining lever has a first finger and a second finger that together form a L-shaped lever whereby the ball is maintained between the two fingers. The ball dropping assembly also comprises a shaft for turning the lever. The shaft also serves as a pin about which the lever pivots from a ball-retained position to a ball released position.

The assembly is located in a side bore adjacent to the main bore in the cementing head. In the ball retained position, the first finger is disposed in the entrance from the side bore to the main bore, thereby preventing the ball from entering the main bore of the cementing head and dropping into the wellbore. Relative to the first finger, the second finger is disposed within the side bore and over the ball. When the ball is ready for release, the lever is rotated in the direction of the main bore, thereby causing the first finger to protrude into the main bore, and simultaneously causing the second finger to urge the ball to unseat and to enter the main bore. This rotation also moves the first finger into position to indicate plug release. When a plug is released into the bore, it will travel down the main bore and trip the first finger, causing the ball retaining lever to rotate back into the ball retained-position. Rotation of the lever causes the shaft to rotate external to the cement head, providing visual confirmation to the operator of plug release downhole.

In one aspect of the invention, the shaft extends perpendicularly through a housing of the cementing head. Sealingly extending the shaft through both sides of the housing provides a pressure-balanced ball dropping assembly that can be actuated with a small amount of torque. Each end of the shaft has an actuating lever for rotating the shaft. The actuating levers are located outside the cementing head and held in position by a detent in the outer wall of the body of the cementing head. The actuating levers also serve as confirmation means for plug release.

An alternative arrangement for a ball dropping assembly is provided, that permits more than one ball to be selectively dropped into the wellbore. In this arrangement, a ball-feeding channel is provided adjacent to the seat. The first ball to be dropped is loaded onto the seat itself. After the first ball has been dropped, the lever is rotated back towards the ball-feeding channel. A biasing feature is provided in the ball-feeding channel, causing the second ball to be urged onto the seat. The ball dropping procedure may then be repeated. In this way, a plurality of balls may be sequentially dropped during a wellbore completion operation.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are not to be considered limiting of its scope, for the invention may admit to other equally effective embodiments.

DETAILED DESCRIPTION OF THE PREFERRED EMBODIMENT

Figure 1B:
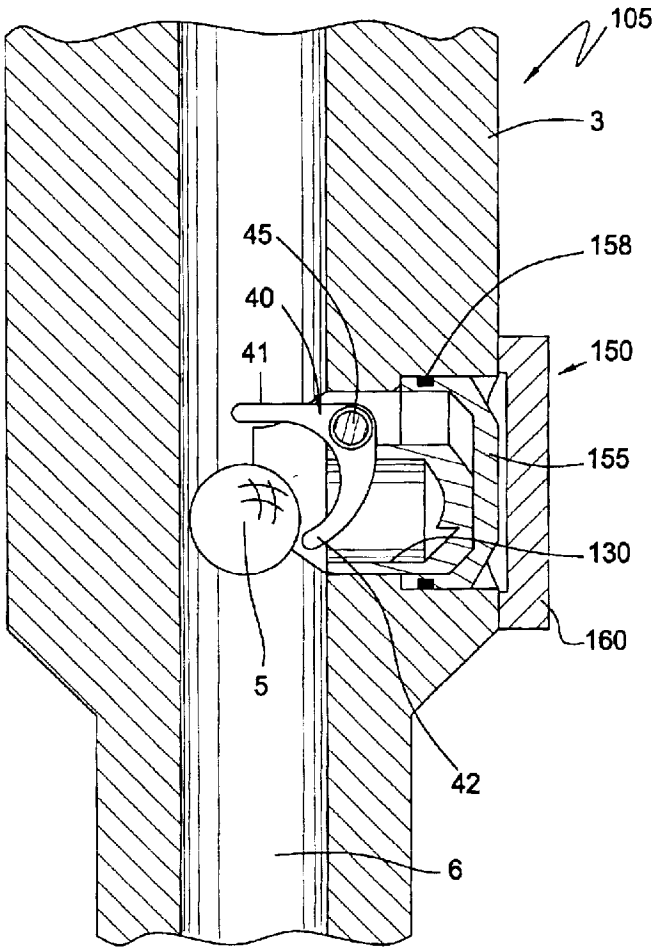
FIG. 1B is a sectional view of the ball dropping assembly of FIG. 1A, in its ball-released position.
Figure 1A:
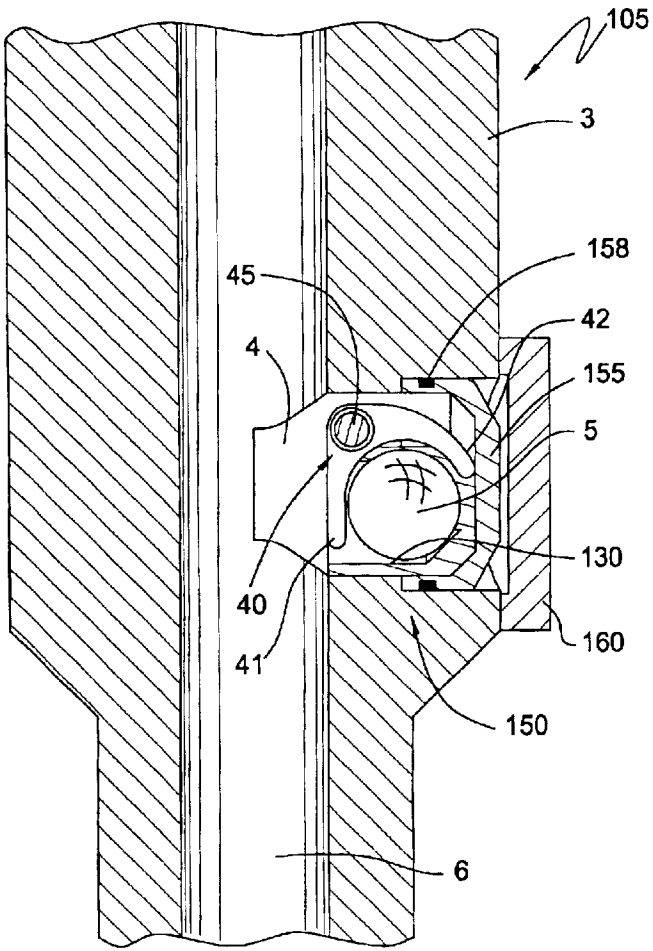
FIG. 1A is a sectional view of a first embodiment of a ball dropping assembly, in a ball-retained position. The ball dropping assembly is shown disposed in a side bore of a cementing head.

FIG. 1A is a partial sectional view of a cementing head 105 showing one embodiment of the ball dropping assembly 150 of the present invention. The ball dropping assembly 150 is shown in a ball-retained position, with a ball 5 disposed therein. The ball dropping assembly 150 is disposed in a side bore 4 that is adjacent to a main bore 6 of a fluid circulation system, such as a cementing head 105.

The ball dropping assembly 150 first comprises a seat 130 for holding the ball 5. The seat 130 defines a base on which the ball 5 sits while the assembly 150 is in the ball-retained position. The ball dropping assembly 150 also comprises a retaining lever 40. The retaining lever 40 retains the ball 5 within the seat 130 until the ball 5 is ready for release into the main bore 6. In the ball-retained position shown in FIG. 1A, the retaining lever 40 acts to prevent the ball 5 from exiting the seat 130.

The retaining lever 40 is disposed within the side bore 4. The retaining lever 40 has a first finger member 41 and a second finger member 42 that meet to form an L-shaped body. Each finger 41, 42 may define a single elongated member as shown in FIG. 1A. However, the term finger also defines any other protrusion for retaining and urging a ball 5. Examples include, but are not limited to a plate, or a fork having tines (not shown).

The retaining lever 40 is positioned in FIG. 1A such that the first finger 41 is disposed between the main bore 6 and the ball 5 so as to retain the ball 5 within the seat 130. The first finger 41 preferably has a flat outer surface that is flush with the main bore 6 so that it does not interfere with any fluid or object that may be traveling down the main bore 6. In the ball-retained position, the ball 5 is initially maintained between the fingers 41, 42. In this regard, finger 42 is oriented inside of the side bore 4. The outer surface of the second finger 42 can be flat or straight. Preferably, the inner surface of the second finger 42 is curved where a spherical ball 5 is used as the dropped object. It should be appreciated that the two fingers 41, 42 do not have to form a perfect "L"; the angle formed by the two fingers 41, 42 may be less than or greater than 90 degrees. In addition, objects other than a spherical ball may be employed as the dropped object. Thus, the term "ball" herein includes any object suitable to be dropped into a wellbore in order to temporarily seal the wellbore.

A shaft 45 is connected to the retaining lever 40 for rotating the retaining lever 40 between a ball-retained position (FIG. 1A) and a ball-released position (FIG. 1B). A cap 155 optionally is disposed at an outer end of the side bore 4 to prevent fluid leakage. The cap 155 has one or more seals 158 disposed around a diameter of the cap 155 to facilitate fluid retention. A retaining sleeve 160 is disposed at the exterior of the cementing head 105 to enclose the ball dropping assembly 150. The use of the cap 155 and retaining sleeve 160 permits the reloading of the ball dropping assembly 150 after a first ball 5 has been dropped. However, it is understood that the ball dropping assembly 150 may be reloaded from the bottom such that a removable cap 155 is not needed. In this way, no disassembly of the ball dropping assembly 150 is needed.

FIG. 1B depicts the ball dropping assembly 150 in its ball-released state. In this view, the retaining lever 40 is rotated such that the first finger 41 enters the main bore 6 and is in the path of a dart or other object moving from the cementing head 105 into the wellbore. Preferably, the retaining lever 40 is rotated 90 degrees so that the first finger 41 is perpendicular to the main bore 6. As shown, a portion of the second finger 42 may be rotated into the main bore 6 to insure that the ball 5 is fully released into the main bore 6. However, it is not necessary that any portion of the second finger 42 enter the main bore 6 once the retaining lever 40 is rotated to the released position, so long as the ball 5 is released.

The retaining lever 40 pivots about shaft 45. Rotation of the shaft 45 rotates the retaining lever 40 between the ball-retained position and the ball-released position. It is preferred that the shaft 45 extend through the body 3 of the cementing head 105 on both sides of the main bore 6. One advantage of having the shaft 45 extend through the body 3 on both sides is that the shaft 45 will be pressure balanced and will not require significant torque to rotate. In addition, and as will be shown, extending the shaft 45 through both sides of the cementing head 105 provides visual confirmation of ball release from either side of the cementing head 105.

Figure 2:
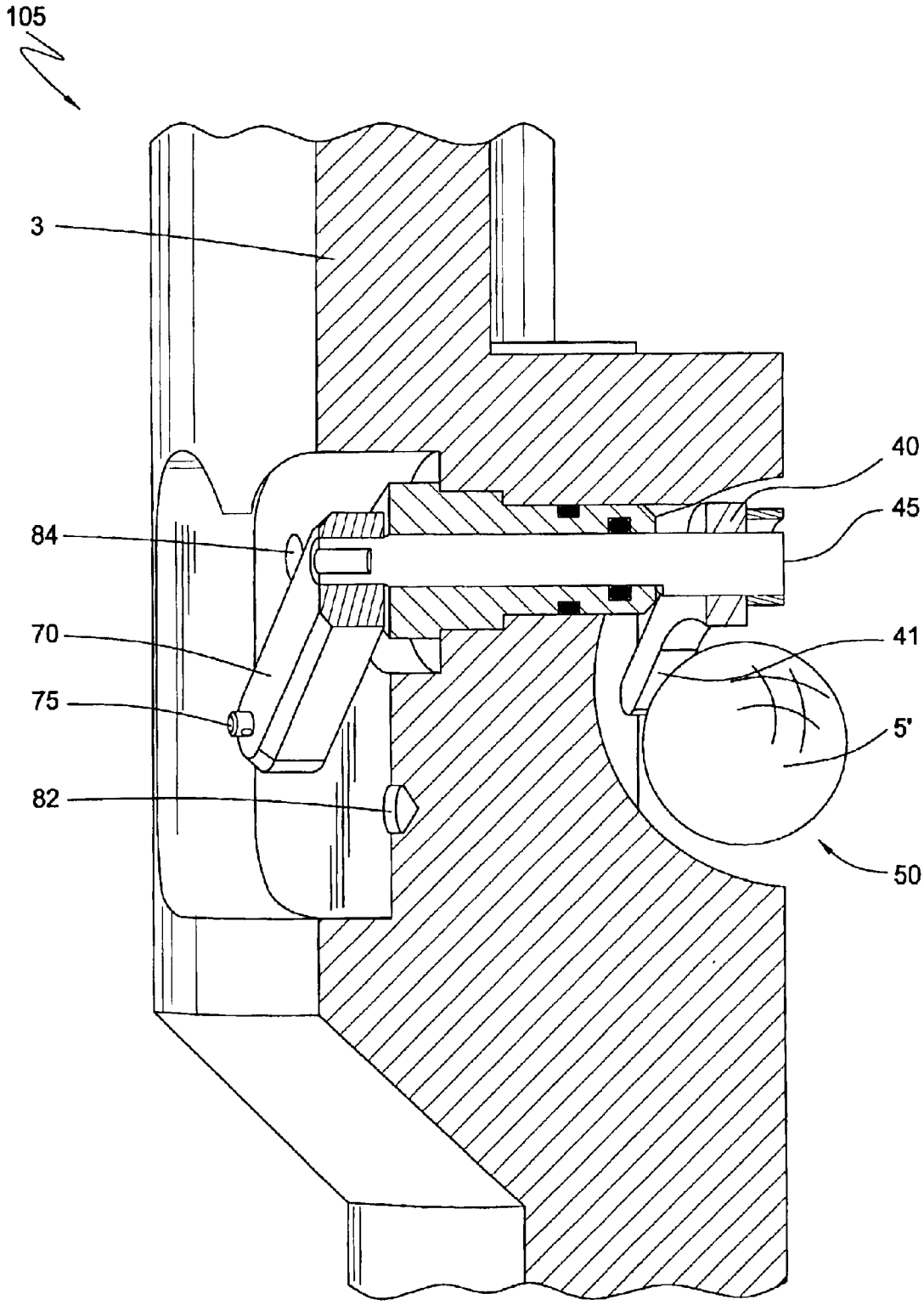
FIG. 2 is a cut-away view of a cementing head showing an aspect of an actuating lever according to the present invention.

FIG. 2 presents the ball releasing assembly 150 in a cross-sectional view. As illustrated in FIG. 2, an actuation lever 70 is connected to at least one end of the shaft 45 for turning the lever 40. Preferably, the actuation lever 70 is disposed on the outer surface of the cementing head 105 so that it may also function as a plug release indicator. A pin 75 is partially disposed in an end of the actuation lever 70 opposite the shaft 45 connection. The outer surface of the cementing head 105 has two detentes 82, 84 for mating with the pin 75. The pin 75 has a biasing mechanism (not shown) that forces the pin 75 into the outer surface of the cementing head 105. When the pin 75 is positioned over one of the detentes 82, 84, the biasing mechanism forces the pin 75 to mate with the détente 82, 84. Once the pin 75 mates with the détente 82, 84, the actuation lever 70 and the retaining lever 40 is held in position until additional force is supplied to force the pin 75 out of the détente 82 or 84.

In operation, the ball dropping assembly 150 is initially in the ball-retained position, with a ball 5 disposed therein. The retaining lever 40 is held in position by the pin 75 mating with a first détente 82. The first finger 41 is disposed entirely within the side bore 4, thereby allowing fluids or objects to travel down the main bore 6 unimpeded by the ball dropping assembly 150. The second finger 42 (visible in FIG. 1B) is disposed adjacent the ball 5 and within the side bore 4.

When the ball 5 is ready for release, the actuation lever 70 is rotated. The pin 75 is forced out of the first détente 82, allowing the actuation lever 70 to be rotated such that the pin 75 engages the second détente 84. Rotating the actuation lever 70 causes the retaining lever 40 to move from its ball-retained position to its ball-released position. As the actuating lever 70 is rotated, the first finger 41 enters the main bore 6 until it reaches a position essentially perpendicular to the main bore 6. The second finger 42 simultaneously rotates toward the main bore 6 approximately 90 degrees and urges the ball 5 into the main bore 6 for release into the wellbore (not shown). When the pin 75 on the actuation lever 70 is above the second détente 84, the pin 75 mates with the second détente 84 to hold the actuation lever 70 and the retaining lever 40 in the ball-released position.

An alternate arrangement of a ball dropping assembly is shown in FIGS. 3A–3E. FIGS. 3A–3E present cross-sectional views of a portion of a cementing head 105. Visible in the cementing head 105 an embodiment of a ball releasing assembly 350 of the present invention. The ball releasing assembly 350 is releasing balls 5', 5" into the main bore 6, whereupon they will fall into the wellbore (not shown).

Figure 3B:
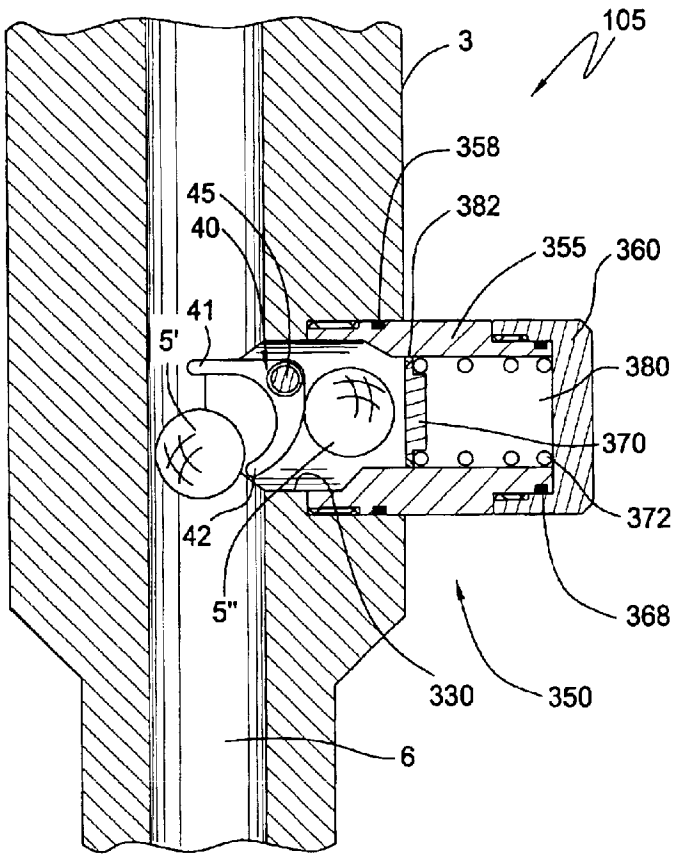
FIG. 3B is a sectional view of the ball dropping assembly of FIG. 3A in its ball released position. In this view, the first ball is being dropped, but the second ball remains in the ball-feeding channel.
Figure 3A:
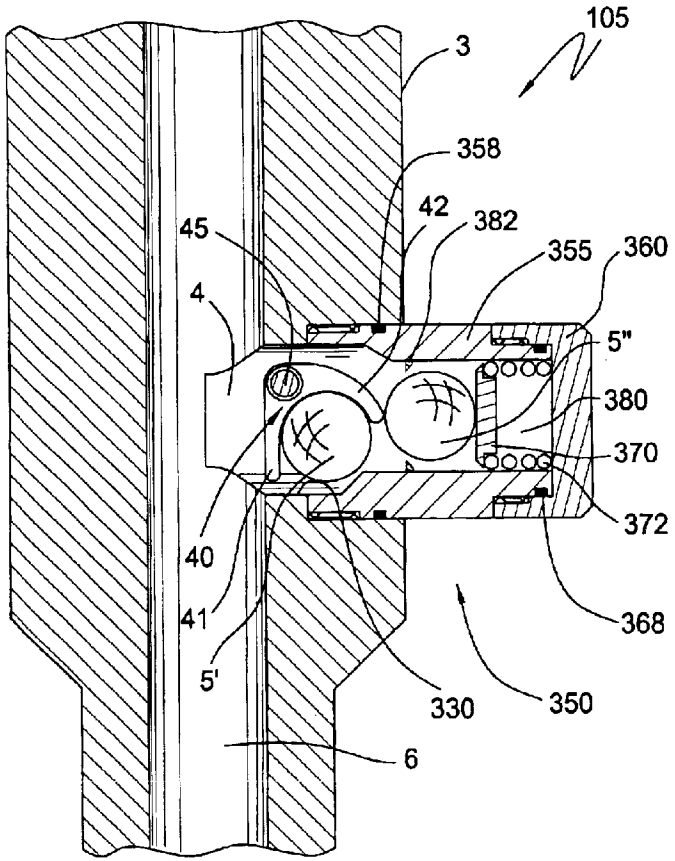
FIG. 3A is sectional view of an alternate embodiment of a ball dropping assembly in a ball-retained position. The ball dropping assembly is again shown disposed in a side bore of a cementing head. A second ball can be seen loaded in a ball-feeding channel.

FIG. 3A presents the alternate embodiment of a ball dropping assembly 350 in a ball-retained position. The ball dropping assembly 350 is again shown disposed in a side bore 4 of a cementing head 105. In this alternate arrangement, a plurality of balls may be selectively dropped into the wellbore. The exemplary view in FIG. 3A presents two balls, 5', 5".

The alternate ball dropping assembly 350 shares features with the first embodiment 150 shown in FIG. 1A. In this respect, each embodiment 150, 350 employs a lever 40 that rotates about a shaft 45. Each embodiment 150, 350 also employs a seat 130, 330, respectively. However, the second embodiment (shown in FIGS. 3A–3E) provides for an elongated ball-feeding channel 380 for receiving one or more balls 5" in addition to the first ball 5'. The ball-feeding channel 380 is the bore in an elongated tubular body 355 threadedly connected to the body 3 of the cementing head 105. A seal 358 is provided at the interface between the tubular body 355 and the cementing head body 3.

A biasing feature is provided in the ball-feeding channel 380 order to urge the additional balls 5" into the seat 330. In the arrangement of FIGS. 3A–3E, the biasing feature defines a plate 370 acted upon by a spring 372. The spring 372 is held in compression in order to provide a constant force against the plate 370. A shoulder 382 is provided along the ball-feeding channel 380 to limit the movement of the plate 370 towards the main bore 6 of the cementing head 105.

It is understood that other biasing feature arrangements may be utilized. For example, the tubular body 355 may simply be tilted at a slight angle, thereby allowing gravity to act against the second ball 5".

In FIG. 3A, the first ball 5' is retained on the seat 330. A second ball 5" can be seen loaded in the ball-feeding channel 380. The second ball 5" is urged by the spring 372 and plate 370 towards the seat 330. However, the second ball 5" cannot enter the seat 330 because it is blocked by the second finger member 42. In this way, the lever 40 selectively receives a single object, e.g., ball 5', one at one time.

FIG. 3B is a sectional view of the ball dropping assembly 350 of FIG. 3A, in its ball released position. In this view, the first ball 5' is being dropped into the wellbore, but the second ball 5" remains in the ball-feeding channel 380. It is noted that the second arm 42 prevents the second ball 5" from entering the seat 330 and from being captured by the lever 40.

FIG. 3C is again a sectional view of the ball dropping assembly 350 of FIG. 3A. In this view, the first ball 5' has been dropped and is no longer visible. The lever 40 has been rotated back towards the ball-feeding channel 380 to receive the second ball 5" from the ball-feeding channel 380. In this view, the lever 40 is in a ball-receiving position. It is understood that rotation of the lever 40 back towards the ball-feeding channel 380 will cause the second finger member 42 to act against the second ball 5", temporarily driving it back further into the ball-feeding channel 380. Once the second finger member 42 clears the second ball 5", the second ball 5" is captured between the first 41 and second 42 finger members of the lever 40 by the biasing feature, e.g., the spring 372 and plate 370.

Figure 3C:
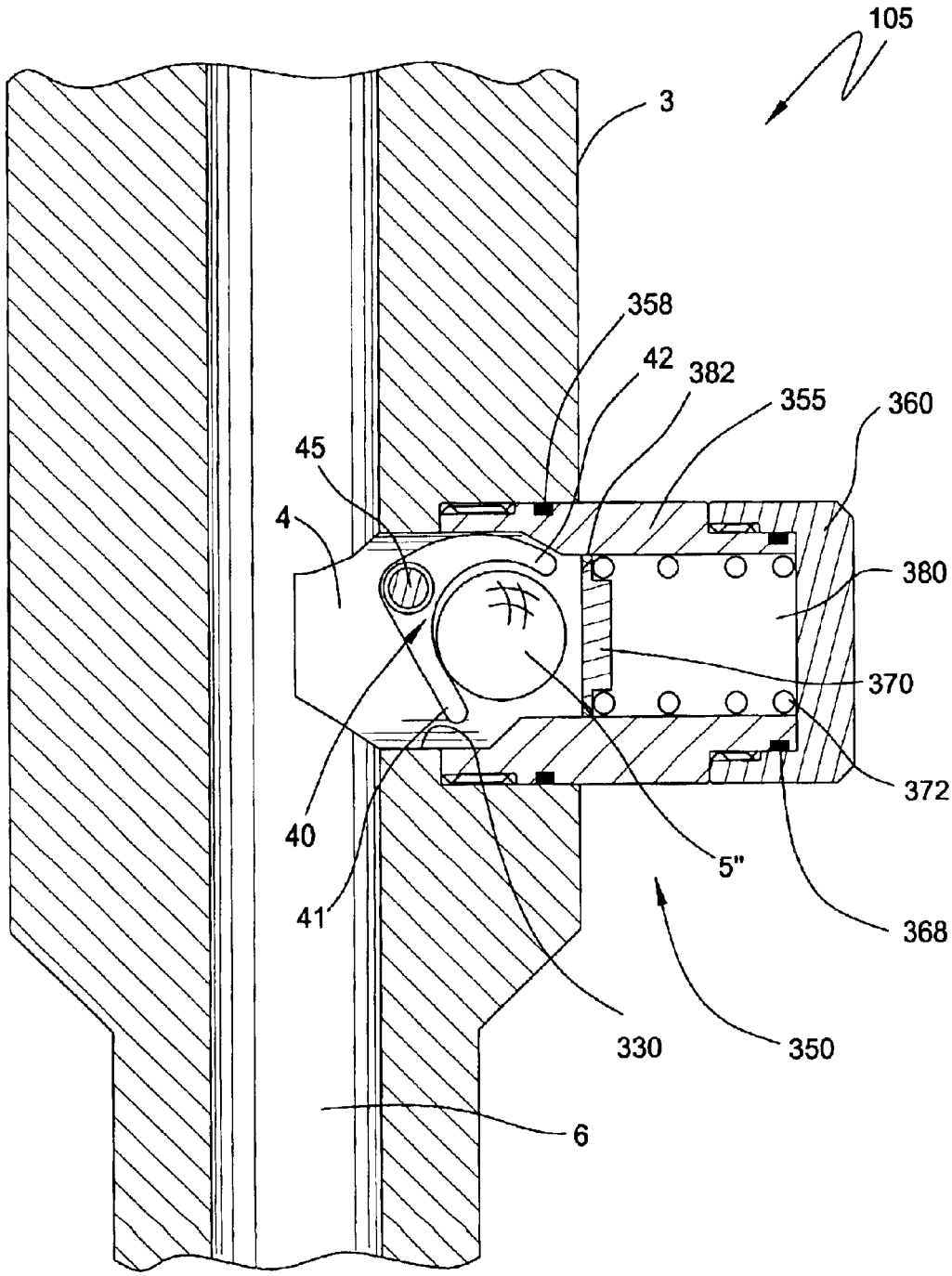
FIG. 3C is a sectional view of the ball dropping assembly of FIG. 3A. In this view, the first ball has been dropped. The lever has been rotated back to receive the second ball from the ball-feeding channel.
Figure 3E:
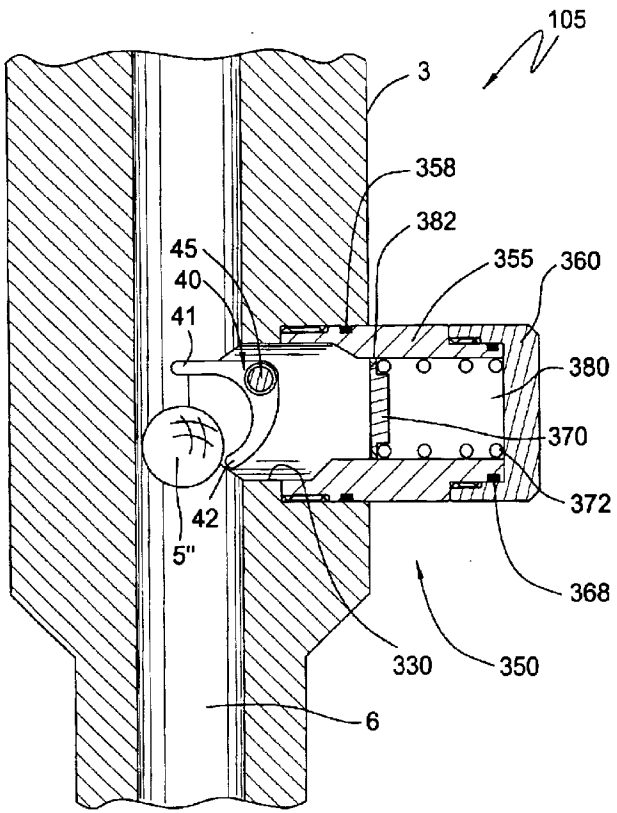
FIG. 3E is a sectional view of the ball dropping assembly of FIG. 3D. In this view, the second ball has been released from the ball dropping assembly.
Figure 3D:
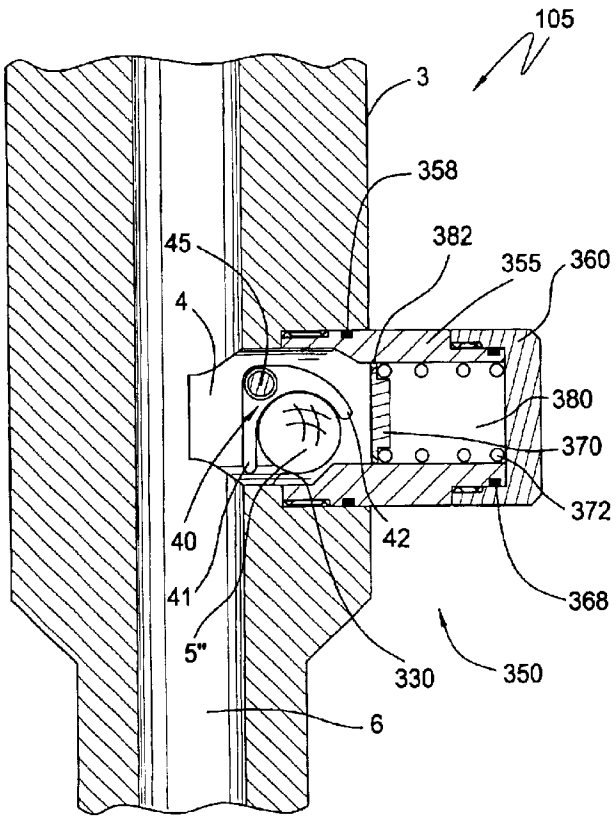
FIG. 3D is a sectional view of the ball dropping assembly of FIG. 3C. In this view, the second ball has been received from the ball-feeding channel. The ball dropping assembly is in its ball-retained position again.

FIG. 3D is a sectional view of the ball dropping assembly 350 of FIG. 3C. In this view, the second ball 5" has been captured by the lever 40. The assembly 350 is now in its ball-retained position again. The second ball 5" is ready to be dropped.

FIG. 3E is a sectional view of the ball dropping assembly of FIG. 3D. In this view, the lever 40 has been rotated so as to move the second ball 5" towards the bore 6. The second ball 5" is being released from the ball dropping assembly 350. The assembly 350 is now in its ball-released position.

In the second ball dropping assembly arrangement 350, the balls 5', 5", etc. are pre-loaded into the ball-feeding channel 380. In order to load the balls 5', 5", the balls 5', 5" must be placed into the elongated tubular body 355. A cap 360 is provided over the tubular body 355 to further pressure seal the ball-feeding channel 380. The cap 360 includes a sealing member 368 at the interface between the tubular body 355 and the cap 360. Thus, loading of the balls 5', 5" is accomplished by removing the cap 360, and placing the balls 5', 5" into the ball-feeding channel 380 of the tubular body 355. The lever 40 is preferably in its ball-retained position during the ball-loading process. The cap 360 is then reattached to the tubular body 355 of the cementing head 105.

In the ball-released position, the retaining lever 40 may function as the plug-release indicator. The process by which plug-release is indicated is shown later in connection with FIGS. 4 and 5.

Figure 4:
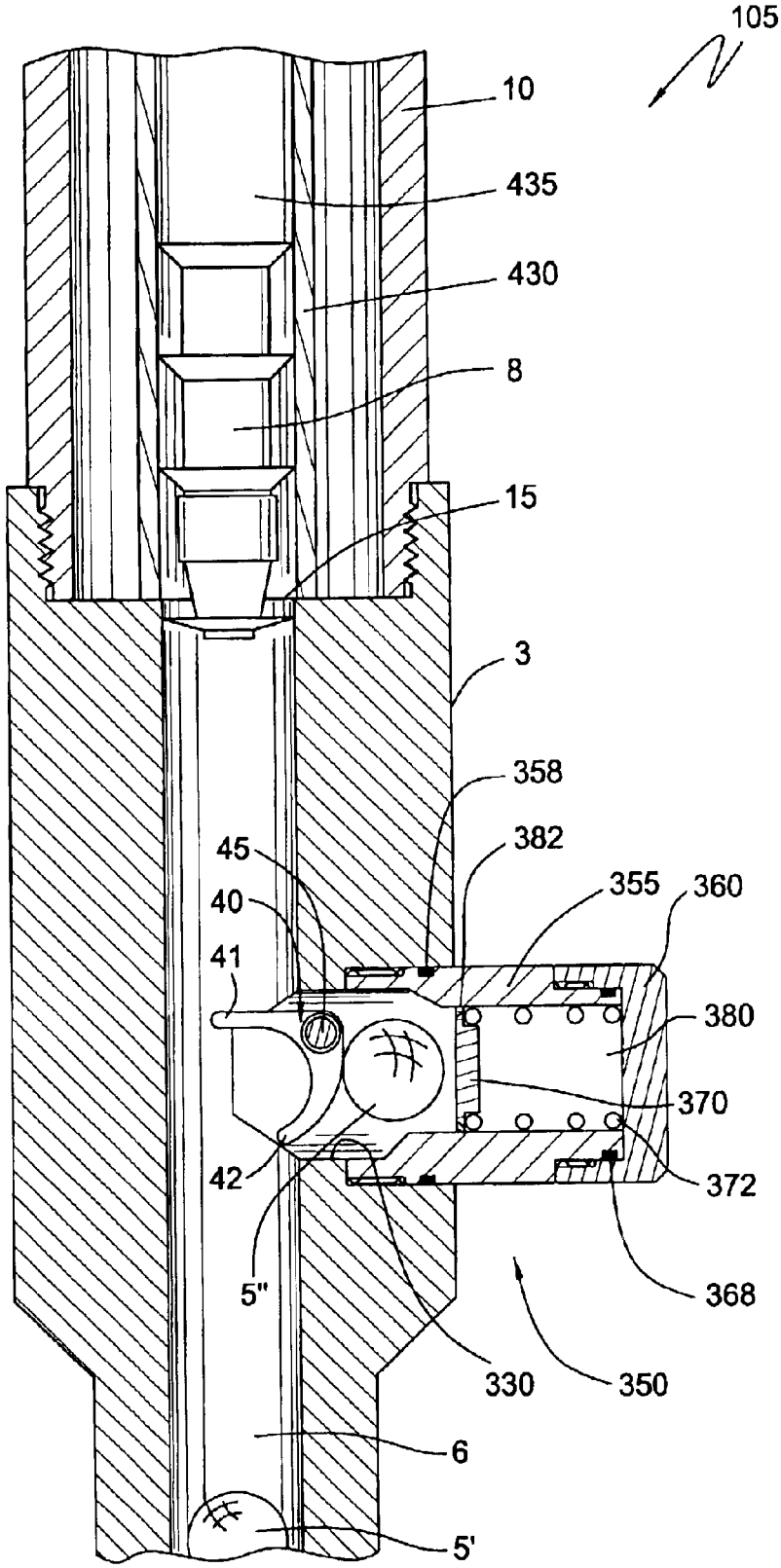
FIG. 4 is a cross-sectional view of a portion of a cementing head. Visible in the cementing head is the ball dropping assembly of FIG. 3B. Also visible is a plug being released from the cementing head above the ball dropping assembly.

FIG. 4 presents a cross-sectional view of the cementing head portion 105 of FIG. 3B. The ball releasing assembly 350 remains in its ball-released position. In this respect, the first ball 5' has been released into the main bore 6 and into the wellbore below. A portion of the first ball 5' is visible within the cementing head 105 in the drawing of FIG. 4. Finger 41 of lever 40 is essentially perpendicular to the main bore 6 of the plug container 105. At this stage, drilling fluid may be introduced into the wellbore (not shown in FIG. 4) to clear debris from the annular space. The second détente 84 supplies sufficient resistance against fluid forces to maintain the first finger 41 in the main bore 6.

After the ball 5' is dropped, a dart 8 is released from the cementing head 105. The dart 8 is visible in FIG. 4. In order to release the dart 8, a plug-dropping container is employed within the cementing head 105. The plug-dropping container primarily defines a canister 430 for retaining a plug 8 until release into the wellbore is desired. The canister portion 430 of a plug-dropping container is partially shown in FIG. 4, with a dart 8 disposed therein. The canister 430 is a tubular shaped member disposed co-axially within a tubular housing 10. The canister 430 has a channel 435 as its bore. The channel 435 is aligned with the bore 6 of the cementing head 105. Preferably, the inner diameter of the canister channel 435 is configured to match the inner diameter of the bore 6.

In operation, the dart 8 is disposed in the canister channel 435 when the cementing head 105 is in a plug-retained position. When released, the dart 8 travels downward out of the canister 430 and through a bottom opening 15. The bottom opening 15 is in fluid communication with the main bore 6.

The typical plug-dropping apparatus includes some means for retaining the dart 8 until plug-release is desired. The typical plug-dropping apparatus also includes some means for diverting fluid around the dart 8 pending plug-release. These features are not shown in FIG. 4. However, it is understood that the ball-dropping assembly 350 will work with any plug-dropping apparatus of any type, so long as the ball-dropping assembly 350 is positioned below the plug-dropping container. Therefore, details concerning any particular plug-dropping container are not needed.

Figure 5:
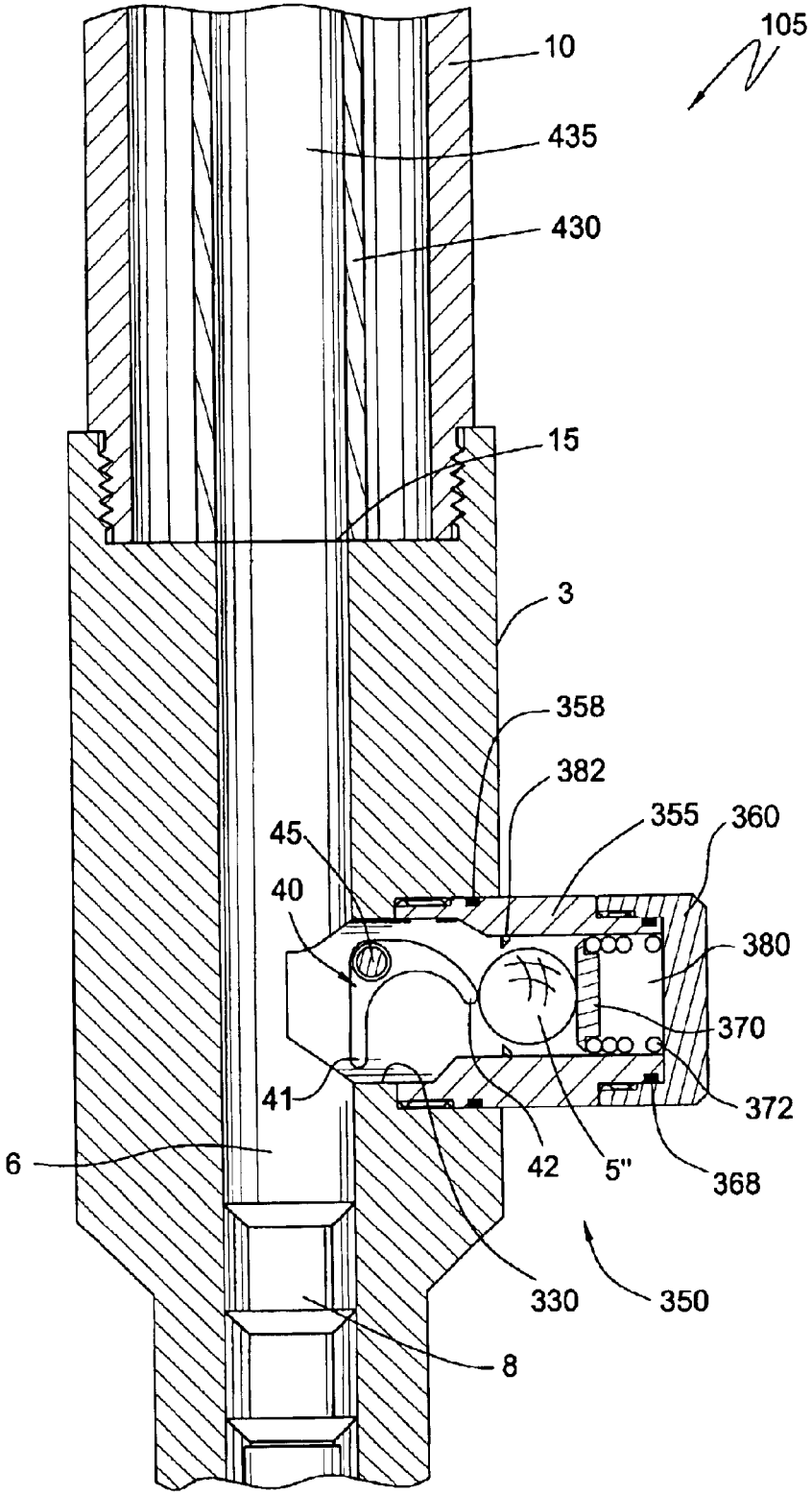
FIG. 5 is a cross-sectional view of the cementing head of FIG. 4. In this view, the plug has traveled through the main bore of the cementing head, and into the wellbore. The plug has also forced the lever of the ball-releasing assembly to return to its ball-retained position.

After the dart 8 is released from a position above the ball dropping assembly 350, the dart 8 travels down the main bore 6 and contacts the first finger 41. FIG. 5 demonstrates the dart 8 further travelling downward into the wellbore. The force from the downward travelling dart 8 releases the pin 75 from the second détente 84 and rotates the retaining lever 40 back toward the ball-retained position. When the pin 75 is moved from the second détente 84, it indicates that the dart 8 was released. Thus, visual confirmation of dart-release is provided to the operator at the surface. Cement or other circulating fluid may subsequently be pumped into the wellbore behind the dart 8.

It may be desirable to release a second dart into the wellbore. Before releasing a new dart, the retaining lever 40 is rotated from its ball-retained position back to its ball-released position. As noted, the retaining lever 40 rotates about pivoting shaft 45 so that it is in position to indicate whether the second dart has been released. In the ball-released position, the first finger 41 of the retaining lever 40 is again disposed in the main bore 6, and the pin 75 is disposed in the second détente 84. Once the second dart is released and contacts the first finger 41, the retaining lever 40 rotates back toward the ball-retained position. The rotation also moves the pin 75 from the second détente 84 toward the first détente 82, thereby indicating that the second dart has been released.

In FIG. 5, it can be seen that a second ball 5" is available for subsequent ball-dropping. In order to drop the second ball 5", the lever 40 must be rotated back towards the ball-feeding channel 380. This, again, will cause the second finger member 42 to act against the second ball 5", temporarily driving it back further into the ball-feeding channel 380. Once the second finger member 42 clears the second ball 5", the second ball 5" is captured between the first 41 and second 42 finger members of the lever 40 by the biasing feature, e.g., the spring 372 and plate 370 (such as is shown in FIG. 3C).

The dart 8 in FIGS. 4 and 5 is presented as a drill pipe dart. However, it is understood that the ball-dropping assemblies 150, 350 have utility with any type of plug, such as a cement wiper plug (not shown).

Figure 6:
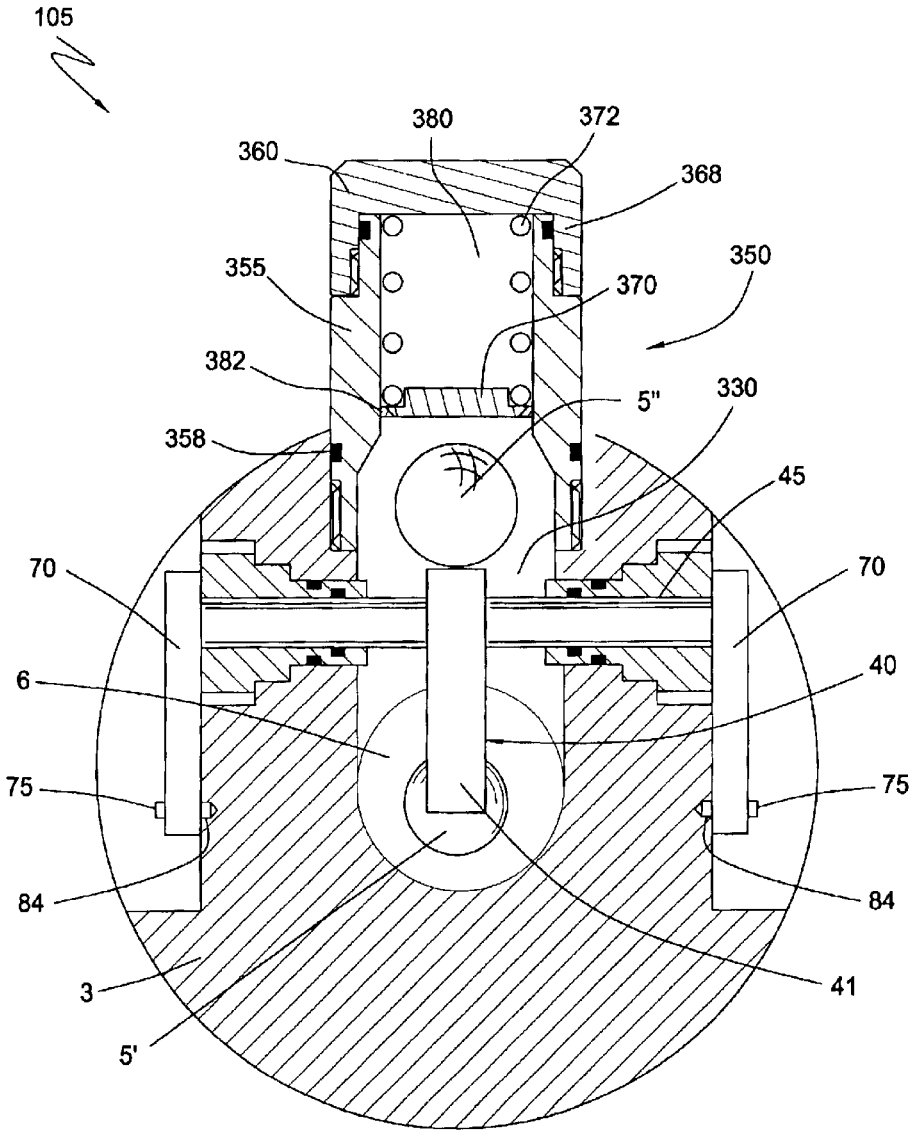
FIG. 6 is a top, cross-sectional view of the ball dropping assembly of FIG. 3A, releasing a ball. Visible is the retaining lever rotating into the main bore of the cementing head.

FIG. 6 depicts the ball releasing assembly 350 from a top, cross-sectional view. Present in this view is the elongated shaft 45. The shaft 45 extends perpendicular to the retaining lever 40. Preferably, and as shown in the embodiment of FIG. 6, the shaft extends from the lever 40 on both sides of the main bore 6. Extending the shaft 45 sealingly through the main bore 6 on both sides provides a pressure-balanced ball-dropping assembly that can be actuated with a small amount of torque.

In the preferred embodiment, each end of the shaft 45 has an actuating lever 70 for rotating the shaft 45. The actuating levers 70 are located outside the cementing head 105 and are held in position by the detents 82, 84 (shown in FIG. 2) in the outer wall of the cementing head 105. It is understood that other arrangements for a combined ball-dropping and dart-release-indicating assembly are within the scope of the present invention.

Therefore, the present invention provides a ball dropping assembly that can effectively and efficiently combine the ball dropping function with the plug-release indicating function into a single apparatus. It is understood, though, that the ball-dropping assembly may be used without the plug-release indicating function. Further, the ball-dropping assembly may be utilized through either manual, power or remote activation.

It is noted that the plug container apparatus shown in FIGS. 4–5 is merely an example, and that the present invention is useful in connection with other procedures and equipment requiring a ball-releasing function. It is also within the scope of the present invention to use the ball-dropping assembly disclosed herein for dropping items other than balls, and for sequentially dropping a plurality of balls.

While the foregoing is directed to embodiments of the present invention, other and further embodiments of the invention may be devised without departing from the basic scope thereof, and the scope thereof is determined by the claims that follow.

What is claimed is:

1. An assembly for dropping at least two objects into a wellbore, comprising:

a seat for holding a first of the at least two objects;

an object-feeding channel disposed within a housing, the object-feeding channel holding all objects to be dropped in addition to the first object, the additional objects being biased to travel from the object-feeding channel onto the seat;

a retaining lever for retaining the first object in the seat, and for selectively receiving each additional object individually after the first object has been dropped into the wellbore; and a shaft through the lever about which the lever pivots between an object-receiving position, an object-retained position, and then an object-released position.

2. The assembly of claim 1, wherein:

the retaining lever has a first finger member and a second finger member; and the first object is initially retained between the first and second finger members when the lever is in its object-retained position and before the lever is rotated to its object-released position.

3. The assembly of claim 2, wherein the first finger member is at least partially disposed in the bore when the lever is in its object-released position.

4. The assembly of claim 3, wherein the lever is rotated from its object-released position back towards its object-retained position when a plug is released into the wellbore and travels downward across the first finger member.

5. The assembly of claim 4, further comprising a cap to prevent fluid leakage from the wellbore.

6. The assembly of claim 4, wherein:

each of the at least two objects is a spherical ball; and the first finger member and the second finger member each define an elongated member which meet to form an essentially 90-degree angle.

7. The assembly of claim 6, wherein the assembly is disposed in a side bore that is adjacent to a main bore of a cementing head.

8. The assembly of claim 7, wherein the first ball may be loaded into the seat without disassembly of the assembly.

9. The assembly of claim 8, wherein the first ball may be loaded into the seat from the bottom of the cementing head.

10. The assembly of claim 1, wherein the shaft extends through a body of a cementing head so as to provide a substantially pressure-balanced configuration.

11. The assembly of claim 10, further comprising at least one actuation lever disposed on an end of the shaft for rotating the shaft, and for providing visual confirmation that the shaft has rotated.

12. The assembly of claim 11, further comprising:

a pin at least partially disposed within the at least one actuation lever; and one or more détentes in the body for mating with the pin.

13. The assembly of claim 12, wherein:

each of the at least two objects is a spherical ball;

the retaining lever has a first finger member and a second finger member; and the first ball is retained between the first and second finger members when the lever is rotated to its object-retained position.

14. The assembly of claim 13, wherein the retaining lever is rotated about the shaft between the object-retained position and the object-released position.

15. The assembly of claim 14, wherein rotating the retaining lever between its object-retained position and its object-released position includes moving the one or more actuation levers between the first détente and the second détente.

16. The assembly of claim 15, wherein the assembly is disposed in a side bore that is adjacent to a main bore of a cementing head.

17. The assembly of claim 16, wherein the first ball may be loaded into the seat from the bottom of the cementing head.

18. The assembly of claim 15, wherein the retaining lever is rotated manually from the object-retained position towards the object-released position.

19. The assembly of claim 15, wherein rotation of the retaining lever is power driven.

20. The assembly of claim 15, wherein rotation of the retaining lever is accomplished remotely.

21. A cementing head, comprising:

a main bore for receiving a plug;

a side bore in fluid communication with the main bore;

a seat disposed in the side bore for releasably retaining a spherical ball;

a ball-feeding channel disposed within a housing, the ball-feeding channel holding one or more balls to be dropped in addition to the first ball; the one or more balls being biased to travel from the ball-feeding channel onto the seat;

a retaining lever for retaining the first ball in the seat, and for selectively receiving each additional ball individually after the first ball has been dropped into the wellbore; and a shaft through the lever about which the lever pivots between a ball-receiving position, a ball-retained position, and then a ball-released position.

22. The cementing system of claim 21, wherein the retaining lever includes a first finger member and a second finger member;

the first spherical ball is contained between the first finger member and the second finger member when the retaining lever is in its ball-retained position; and the first finger member protrudes into the main bore when the retaining lever is in its ball-released position.

23. The cementing system of claim 22, wherein the shaft extends through each side of a bore in the cementing head.

24. The cementing head of claim 22, wherein the retaining lever is rotated manually from the ball-retained position towards the ball-released position.

25. The cementing head of claim 22, wherein rotation of the retaining lever is power-driven.

26. The cementing head of claim 22, wherein rotation of the retaining lever is accomplished remotely.

27. The cementing head of claim 22, further comprising at least one actuation lever disposed on an end of the shaft for turning the retaining lever, and for providing visual confirmation that the shaft has been rotated.

28. The cementing head of claim 27, further comprising:

a pin at least partially disposed within the at least one actuation lever; and one or more detentes disposed on an outer surface of the body for receiving the pin.

29. The cementing head of claim 28, wherein moving the pin from a first détente to a second détente rotates the retaining, lever from its ball-retained position to its ball-released position.

30. The cementing head of claim 29, wherein the retaining lever is rotated from its ball-released position towards its ball-retained position when a plug is released from the cementing head downhole and travels past the first finger, such that rotation provides confirmation of plug-release.

* * * * *